US005458075A

United States Patent [19]

Tice et al.

[11] Patent Number: 5,458,075

[45] Date of Patent: Oct. 17, 1995

[54] ELECTRONICALLY GEARED SEWING MACHINE

[75] Inventors: William A. Tice; Moshe Shloush; Mark E. Stapel, all of Knoxville, Tenn.

[73] Assignee: Tice Engineering and Sales, Inc., Knoxville, Tenn.

[21] Appl. No.: 306,708

[22] Filed: Sep. 15, 1994

[51] Int. Cl.[6] ..... D05B 21/00

[52] U.S. Cl. ..... 112/470.04; 112/155; 112/220; 112/221; 112/275; 112/470.06; 112/475.25; 112/475.05

[58] Field of Search ..... 112/121.12, 121.11, 112/220, 221, 275, 277, 155, 445, 262.3, 266.1, 262.1, 103, 456, 458

[56] References Cited

U.S. PATENT DOCUMENTS

| | | | |
|---|---|---|---|
| 3,450,076 | 6/1969 | Bender | 112/79 |
| 3,515,080 | 6/1970 | Ramsey | 112/121.14 |
| 3,799,089 | 3/1974 | Tolle | 112/217.3 |
| 3,977,339 | 8/1976 | Tice | 112/219 |
| 3,984,745 | 10/1976 | Minalga | 318/567 |
| 4,215,639 | 8/1980 | Johnson | 112/242 |
| 4,369,722 | 1/1983 | Nishida et al. | 112/103 |
| 4,389,951 | 6/1983 | Von Hagen | 112/121.27 |
| 4,459,925 | 7/1984 | Miyachi et al. | 112/70 |
| 4,459,926 | 7/1984 | Ohniwa | 112/121.12 |
| 4,467,737 | 8/1984 | Breck, Jr. | 112/121.14 |
| 4,490,656 | 12/1984 | Arnold | 112/277 X |
| 4,503,788 | 3/1985 | Giannuzzi et al. | 112/121.12 |
| 4,627,369 | 12/1986 | Conrad et al. | 112/103 |
| 4,658,741 | 4/1987 | Jehle et al. | 112/262.1 |
| 4,690,081 | 9/1987 | Castagna et al. | 112/276 |
| 4,754,721 | 7/1988 | Skogward | 112/275 |
| 4,815,404 | 3/1989 | Ellermann et al. | 112/121.11 |

(List continued on next page.)

FOREIGN PATENT DOCUMENTS 8794499 8/1971 Canada .

OTHER PUBLICATIONS

Hauser Quilter SNA 2000, Apparel Industry Magazine, Sep. 1993, p. 156.

Hauser Automation Inc., Apparel Industry Magazine, Sep. 1992, p. 140.

The Fastest Quilter in Half the Space—The new Hauser SNA 2000, Apparel Industry Magazine, Sep. 1992, p. 144.

Kaybematic III, Bobbin Magazine, Jun. 1992, p. 103.

"High Performance PC Bus Motion Controller," by Galil, Rev (Jan. 1994), Galil Motion Control, Inc., 575 Maude Court, Sunnyvale, Calif. 94086–2028.

"Compax M—System Description," by Hauser, Aug. 6, 1994 16:32, 192–040011 N8, Juni94 (Hauser Motin Control, 2311 Highway 292, P.O. Box 38, Inman, S.C. 29349).

"Dependability Without a Doubt," by Hauser, SNA–2000 Brochure (2 pages).

*Primary Examiner*—Peter Nerbun

*Attorney, Agent, or Firm*—Luedeka, Neely & Graham

[57] ABSTRACT

This invention relates to a method and apparatus for electronically gearing the sewing parts of a sewing machine, and more particularly it relates to electronically gearing the bobbin to the needle to eliminate the necessity of their physical coupling through mechanical linkages and drive shafts. Servo motors provide torque to the needle, bobbin, and various other sewing parts of the sewing machine which require concerted movement. A computer uses servo motor positional information to calculate motion commands that are sent to the needle and bobbin servo motors, thereby enabling electronic gearing of the bobbin to the needle so that each moves substantially in unison. Motion commands sent to servo motors attached to various other sewing parts of the sewing machine are based on servo motor positional information to enable the sewing parts to move in concert with the needle and bobbin. Servo motors move the fabric in two dimensions during stitching, and each move of the fabric is calculated to consume the maximum amount of time available between stitches in order to dampen acceleration and deceleration of sewing parts and eliminate problems associated with machine jerk.

37 Claims, 7 Drawing Sheets

U.S. PATENT DOCUMENTS

| | | | |
|---|---|---|---|
| 4,834,007 | 5/1989 | Miyazaki et al. | 112/121.11 |
| 4,843,986 | 7/1989 | Kozuka et al. | 112/163 |
| 4,849,902 | 7/1989 | Yokoe et al. | 364/470 |
| 4,860,678 | 8/1989 | Skogward | 112/445 |
| 4,867,080 | 9/1989 | Taylor et al. | 112/80.32 |
| 4,936,232 | 6/1990 | Monma | 112/155 X |
| 4,943,906 | 7/1990 | Tajima et al. | 364/188 |
| 4,955,305 | 9/1990 | Garnier et al. | 112/121.11 |
| 4,981,091 | 1/1991 | Taylor et al. | 112/80.32 |
| 4,989,527 | 2/1991 | Off | 112/121.15 |
| 5,005,498 | 4/1991 | Taylor et al. | 112/80.32 |
| 5,005,501 | 4/1991 | Kita | 112/121.12 |
| 5,009,176 | 4/1991 | Shigeta et al. | 112/121.12 |
| 5,016,550 | 5/1991 | Horie et al. | 112/454 |
| 5,074,232 | 12/1991 | Matsubara et al. | 112/445 |
| 5,088,429 | 2/1992 | Kanegae | 112/221 X |
| 5,105,750 | 4/1992 | Horie | 112/302 |
| 5,144,902 | 9/1992 | Hirabayashi | 112/292 |
| 5,179,520 | 1/1993 | Hayakawa | 364/470 |
| 5,189,971 | 3/1993 | Frankel et al. | 112/220 |
| 5,211,119 | 5/1993 | Tagawa et al. | 112/121.11 |
| 5,227,976 | 7/1993 | Hayakawa | 364/470 |
| 5,255,620 | 10/1993 | Sasano et al. | 112/121.12 |
| 5,283,747 | 2/1994 | Komuro et al. | 364/470 |
| 5,299,519 | 4/1994 | Hirabayashi | 112/456 |
| 5,322,027 | 6/1994 | Hashiride et al. | 112/220 |
| 5,383,412 | 1/1995 | Sakakibara et al. | 112/78 |

ELECTRONICALLY GEARED SEWING MACHINE

TECHNICAL FIELD

The present invention is directed to a sewing machine which utilizes positional information signals to electronically gear the motion of the needle to the motion of the bobbin.

BACKGROUND OF THE INVENTION

Precision timing is required between the needle and bobbin movements of a sewing machine. In order to link the motion of the needle to that of the bobbin, conventional sewing machines use mechanical linkages, gears, drive shafts, timing belt, and other mechanisms to mechanically connect and mechanically gear the bobbin to the needle. An arm is used to position the needle above the bobbin, with the linkages between the needle and bobbin being routed through the arm. A single motor is typically used to drive both needle and bobbin by way of the mechanical gearing connecting them to each other.

Several disadvantages result from mechanically linking the needle and bobbin. The speed of the sewing machine is limited by the inertia and friction caused by the mechanical linkages. These mechanical linkages require constant lubrication. Reliability suffers from a system that employs so many moving parts. Additional power is required to accelerate and decelerate the mass of linkages. As a result, greater heat dissipation is required to prevent overheating. Noise levels are increased as a result of these moving mechanical parts. Finally, the ergonomic disadvantages associated with mechanically linking the needle and bobbin diminishes the sewing machine's versatility by limiting the mobility and location of the sewing head (needle and bobbin).

Attempts have been made to physically separate the needle and bobbin and to use separate electric motors to synchronize the needle with the bobbin. In U.S. Pat. No. 3,515,080, Ramsey discloses a sewing machine having physically separate needle and bobbin drive units that are purportedly synchronized. Stepper motors are disclosed as the drive units, and each drive unit is "electrically connected and operated in synchronism and in unison". However, Ramsey does not disclose a system or mechanism for electronically linking (gearing) the needle to the bobbin. Ramsey discloses in some detail a control system for moving the needle and bobbin laterally in the X-Y plane and for rotating them about the Z-axis, but there is little or no disclosure of how the needle and bobbin are driven or controlled for sewing (i.e., how the up and down motion of the needle and the rotation of the bobbin is controlled so that the bobbin hook engages and hooks the thread carried by the needle).

The prior art provides an inflexible approach to coordinating the needle and bobbin movements during sewing. Whenever a needle type is changed, or the material thickness varies, or the bobbin is switched to a looper, a sewing parameter has been varied. Prior art machines are unable to automatically adjust to these changed parameters. Instead, prior art machines employing physically separate needle and bobbin must be manually reset to function within the new parameters.

SUMMARY OF THE INVENTION

The present invention aims to overcome the difficulties presented by the prior art by electronically gearing the motion of the needle to that of the bobbin with the use of positional information. By so doing, the present invention aims to eliminate any mechanical connections between the needle and bobbin, thereby improving efficiency, reliability, and versatility. Another object of the present invention is to reduce or eliminate the need for user intervention whenever a sewing parameter is changed. Another object of the present invention is to improve safety by continuous motor torque monitoring. A still further object of the present invention is to provide the ergonomic advantage of being able to mount the sewing head wherever it is needed so that the sewing head may be presented to the material, and to provide the capability for multiple head applications.

Regarding the foregoing and other objects of the invention, the present invention provides a sewing apparatus for sewing a thread through a material. The sewing apparatus has a plurality of sewing parts moving in a sewing motion through a range of sewing positions to sew a thread in the material. Servo motors are connected to the sewing parts to produce the sewing motion. Monitors continuously monitor the sewing positions of the moving sewing parts and produce monitor signals corresponding to the sewing positions. Data acquisition and control means receive the monitor signals and produce motion commands for each servo motor to enable electronic gearing of the sewing parts so that the sewing parts move in concert with each other. A user interface connected to the data acquisition and control means enables the user to select stitch patterns stored in electronic storage and to set various other sewing parameters.

A means for disabling all of the servo motors is provided in the event the torque on any of the servo motors exceeds predetermined limits. A handwheel is also provided to enable manual mode, electronically geared movement of the sewing parts.

In a preferred embodiment, this invention provides a sewing apparatus having mechanically separate needle and bobbin drive units for sewing fabric. The sewing apparatus includes a servo motor connected to a needle to form a needle assembly, and a servo motor connected to a bobbin to form a bobbin assembly. The needle and bobbin assemblies combine to form a sewing head where each assembly is operatively located on opposite sides of the fabric while sewing. A needle monitor produces signals corresponding to the positions of the needle, and a bobbin monitor produces signals corresponding to the positions of the bobbin. A controller receives the needle and bobbin monitor signals and produces motion commands for the needle and bobbin as a function of the monitor signals, thereby enabling electronic gearing of the bobbin to the needle. Monitor signals are produced by encoders attached to the servo motors. A user interface connected to the digital controller enables the user to electronically store, and subsequently select from electronic storage, stitch patterns and other sewing parameters.

Also provided is a means for two-dimensional movement of the fabric between stitches. To dampen otherwise jerky machine motions and to provide a smooth, tight stitch, each movement of the fabric consumes the maximum amount of time allowable between stitches.

Multiple head applications are enabled by this invention. Multiple sewing heads are connected to the controller so that the needle and bobbin of each individual sewing head are electronically geared.

In another preferred embodiment, this invention provides a method for electronically gearing a plurality of sewing parts on a sewing machine wherein the sewing machine has at least one needle and one bobbin. The first step of this method requires designating one of the electronically geared parts as master. The second step of this method requires designating all other electronically geared parts as slave. The third step requires initializing all electronically geared parts to a "home" position. The fourth step requires monitoring the positions of all electronically geared parts. The fifth step requires commanding movement of the designated master part. The final step requires commanding movement of the slave parts as a function of the monitored position of the master part. Position monitoring of sewing parts enables flipflopping of the master and slave designations if one of the slaved parts is unable to keep up with the master.

Another preferred embodiment of this invention provides a sewing apparatus having a sewing needle for sewing a thread through a material. A needle motor drives the needle through a range of positions in a reciprocating motion to sew the thread in the material. A needle drive is connected to the needle motor for providing power to the needle motor. A handwheel enables manual control of the position of the needle in its range of reciprocating motion by means of a handwheel monitor. The handwheel monitor monitors the position of the handwheel and produces a handwheel monitor signal corresponding to handwheel movements. A controller, responsive to the handwheel monitor signal, controls the needle motor to move the needle in its range of reciprocating motion in response to motion of the handwheel.

BRIEF DESCRIPTION OF THE DRAWINGS

Relative to the drawings wherein like reference characters designate like or similar elements throughout the several drawing figures.

DETAILED DESCRIPTION OF THE PREFERRED EMBODIMENT

Figure 1:
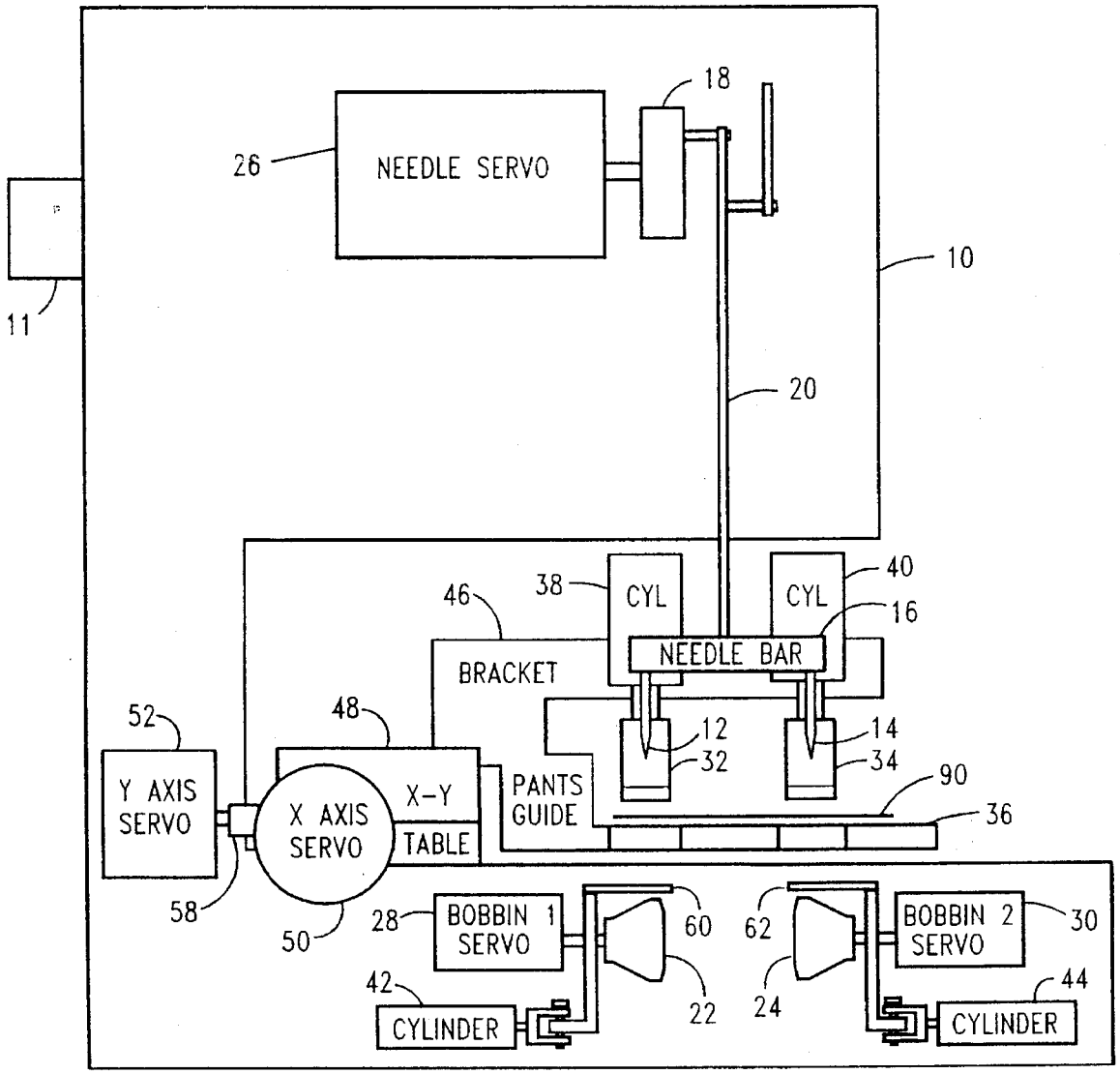
FIG. 1 is a schematic diagram of a two-needle, belt loop tacking, electronically geared sewing machine.
Figure 2:
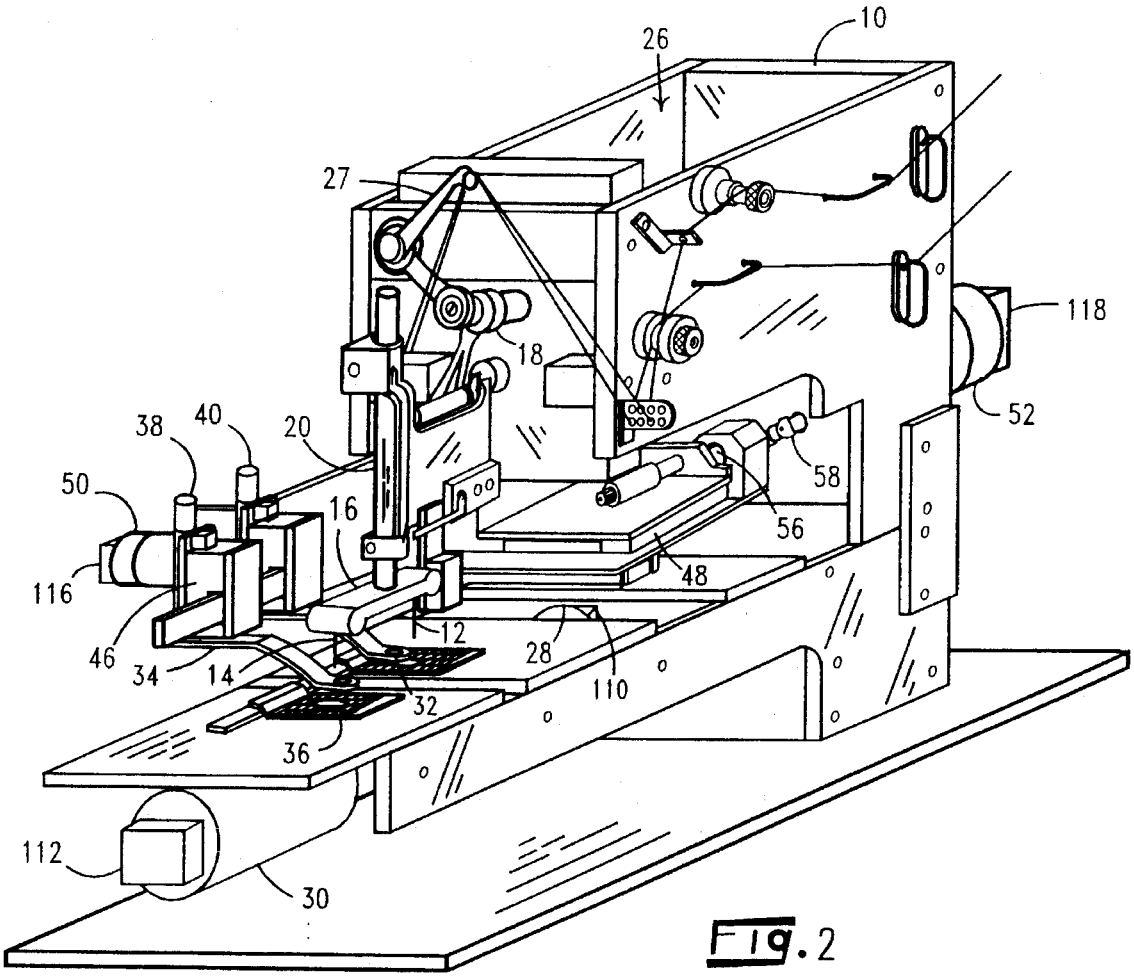
FIG. 2 is an overall illustration of the apparatus of this invention.

In accordance with a preferred embodiment of the present invention as shown in FIGS. 1 and 2, the hardware configuration for an electronically geared, two-needle, belt-loop tacking, sewing machine 10 is illustrated. Sewing is enabled by electronic gearing of the needles 12 and 14 to the bobbins 22 and 24. Each of the bobbins 22 and 24 have a hook for hooking the thread during sewing to create a lockstitch. Alternatively, a looper replaces the bobbin and hook to create a chainstitch. (For simplicity, a bobbin with a hook or a looper will hereinafter be referred to as a bobbin.) There are no mechanical synchronizing linkages or drive shafts connecting the needles 12 and 14 to the bobbins 22 and 24. Elimination of the mass associated with drive shafts and mechanical linkages enables the sewing machine 10 to reach top speed quickly due to lower inertia, thus eliminating many of the problems associated with acceleration and deceleration of the sewing machine 10. Advantages realized by the elimination of these moving parts includes improved reliability, reduced heat and noise levels, and lower energy consumption.

With continued reference to FIGS. 1 and 2, the two needles 12 and 14 are rigidly connected by a needle bar 16 so that they each move in perfect unison. The needle bar 16 connects to a flywheel 18 via a shaft 20. The flywheel 18 is driven by a servo motor 26. By attaching the needle bar shaft 20 to the flywheel 18 at a point offset from the flywheel's center, vertical needle sewing motion is produced as the needle servo motor 26 turns the flywheel 18. Each of the bobbins 22 and 24 are driven by servo motors 28 and 30. Each of the bobbin servo motors 28 and 30 operate at twice the speed of the needle servo motor 26. Beneath each of the needles 12 and 14 is a pneumatically actuated foot 32 and 34 for holding the fabric 90 in the pants guide 36 while sewing. Each foot 32 and 34 is moved vertically by a pneumatic cylinder 38 and 40 during sewing. When the feet 32 and 34 are actuated, the fabric 90 is held firmly between the feet 32 and 34 and the pants guide 36 to provide uniform stitching and to enable two dimensional movement of the fabric 90 during sewing. When stitching is complete, trimmers 60 and 62 are actuated by pneumatic cylinders 42 and 44, thereby cutting the bobbin and needle threads.

With continued reference to FIGS. 1 and 2, the fabric 90, when held in place by actuation of the foot cylinders 38 and 40, is moved in an X axis direction and a Y axis direction in relation to the needles 12 and 14 which remain stationary in the X-Y plane. This X-Y motion enables the sewing machine 10 to sew a variety of stitch patterns. The two foot cylinders 38 and 40, the two feet 12 and 14, and the pants guide 36 are rigidly connected to a bracket 46. The bracket 46 is rigidly connected to an X-Y table 48 so that movement of the X-Y table 48 induces equal movement in the feet 12 and 14, foot cylinders 38 and 40, and the pants guide 36.

Figure 3:
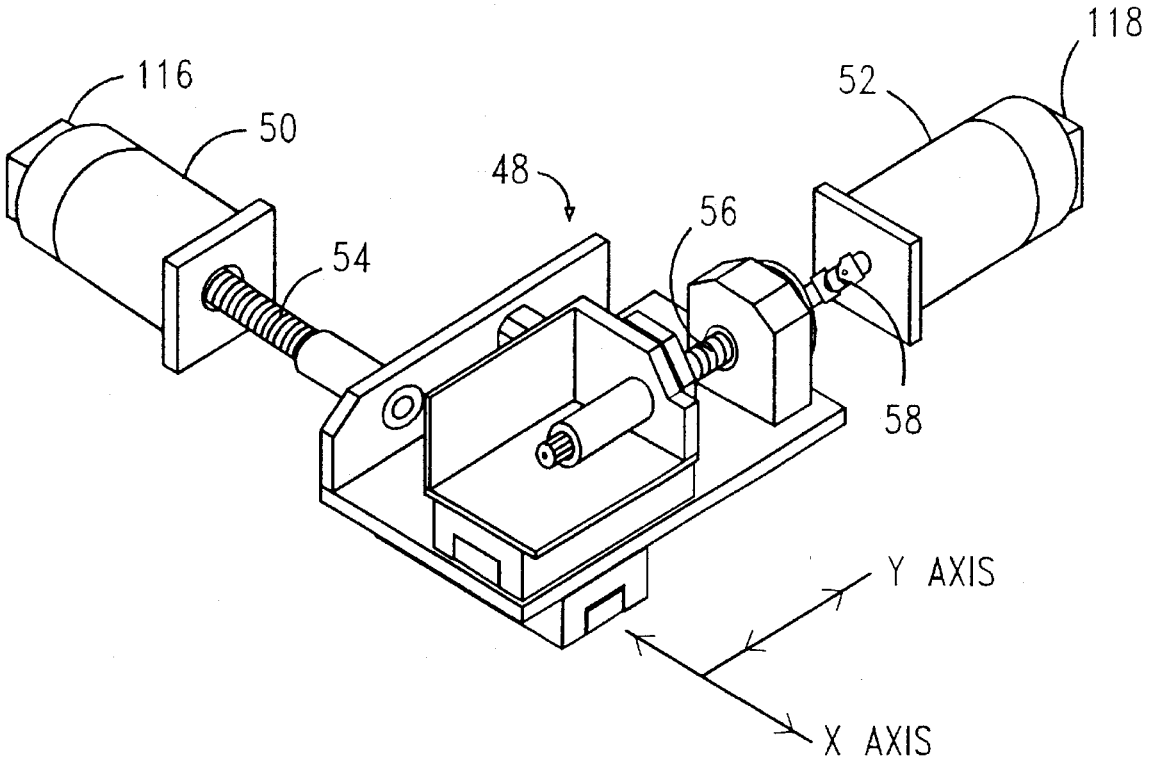
FIG. 3 is a somewhat isometric view of the X-Y table with servo motors attached.

As shown in FIGS. 1 and 3, the motion of the X-Y table 48 is controlled by two servo motors. An X axis servo motor 50 controls movement along the X axis by turning a translational screw 54 attached to the X-Y table 48. A Y axis servo motor 52 controls movement along the Y axis by turning a translational screw 56 attached to the X-Y table 48. A universal, telescoping coupling 58 interconnects the Y axis translational screw 56 with the Y axis servo motor 52, thereby enabling unobstructed movement of the Y axis translational screw 56 along the X axis.

Figure 4:
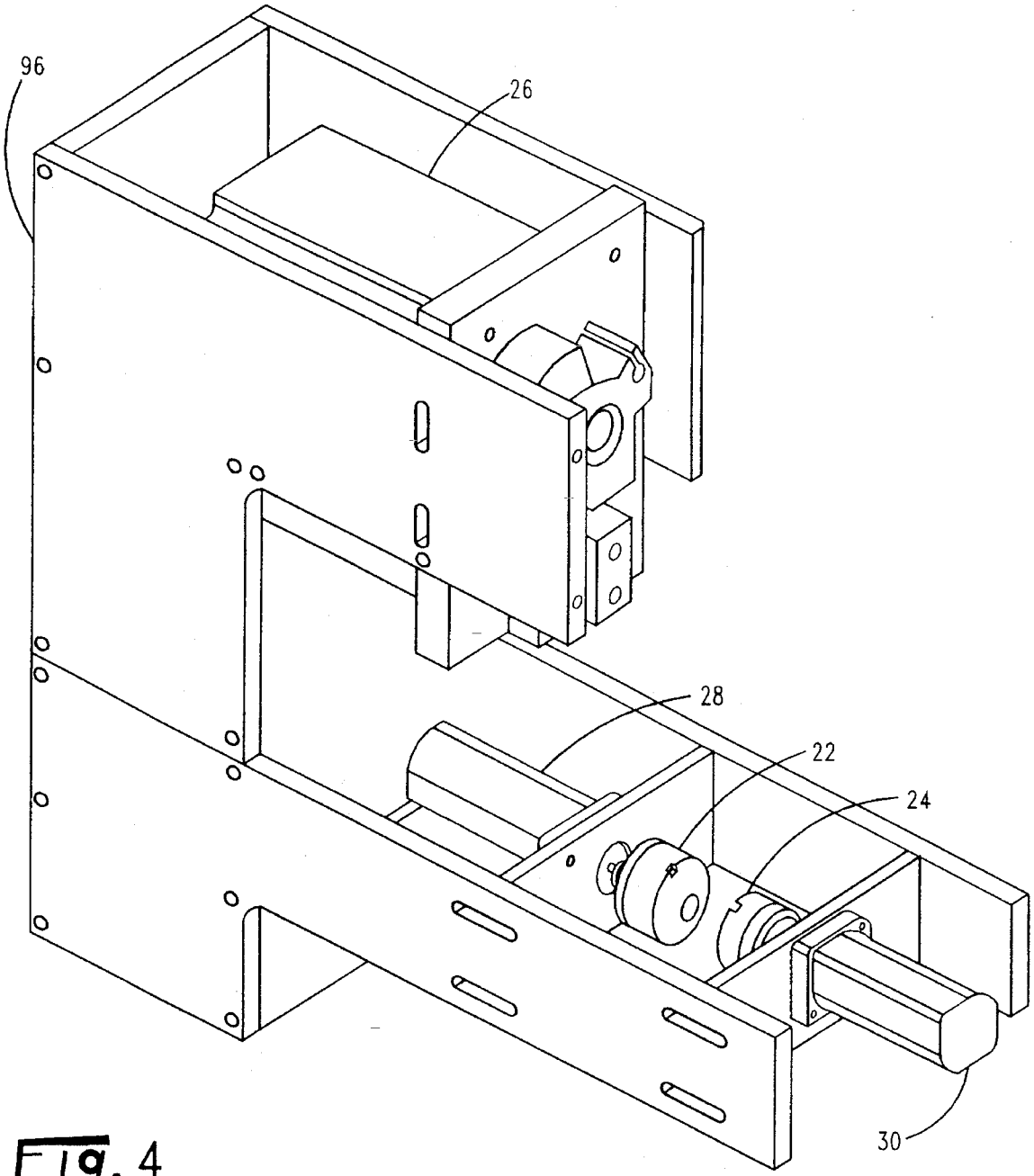
FIG. 4 is a somewhat isometric view of the sewing machine chassis with servo motors attached.

FIG. 4 is an illustration of the sewing machine chassis 96 with the needle servo motor 26 and bobbin servo motors 28 and 30 installed. The bobbins 22 and 24 are shown connected to their respective servo motors 28 and 30.

Position monitoring of the sewing parts enables electronic gearing of the movements of the sewing parts. Sewing parts are parts that are required to be rigorously moved during sewing operations, including the needles 12 and 14 and the bobbins 22 and 24. An example of a sewing part not shown in FIGS. 1 and 2 is an electronic thread take-up. A conventional thread tensioner 27 is used in the preferred embodiment in place of an electronic thread take-up. Although the preferred embodiment uses rotary servo motors for movement of the needles 12 and 14, bobbins 22 and 24, and X-Y table 48, it will be understood that linear servo motors may be used instead.

Figure 5:
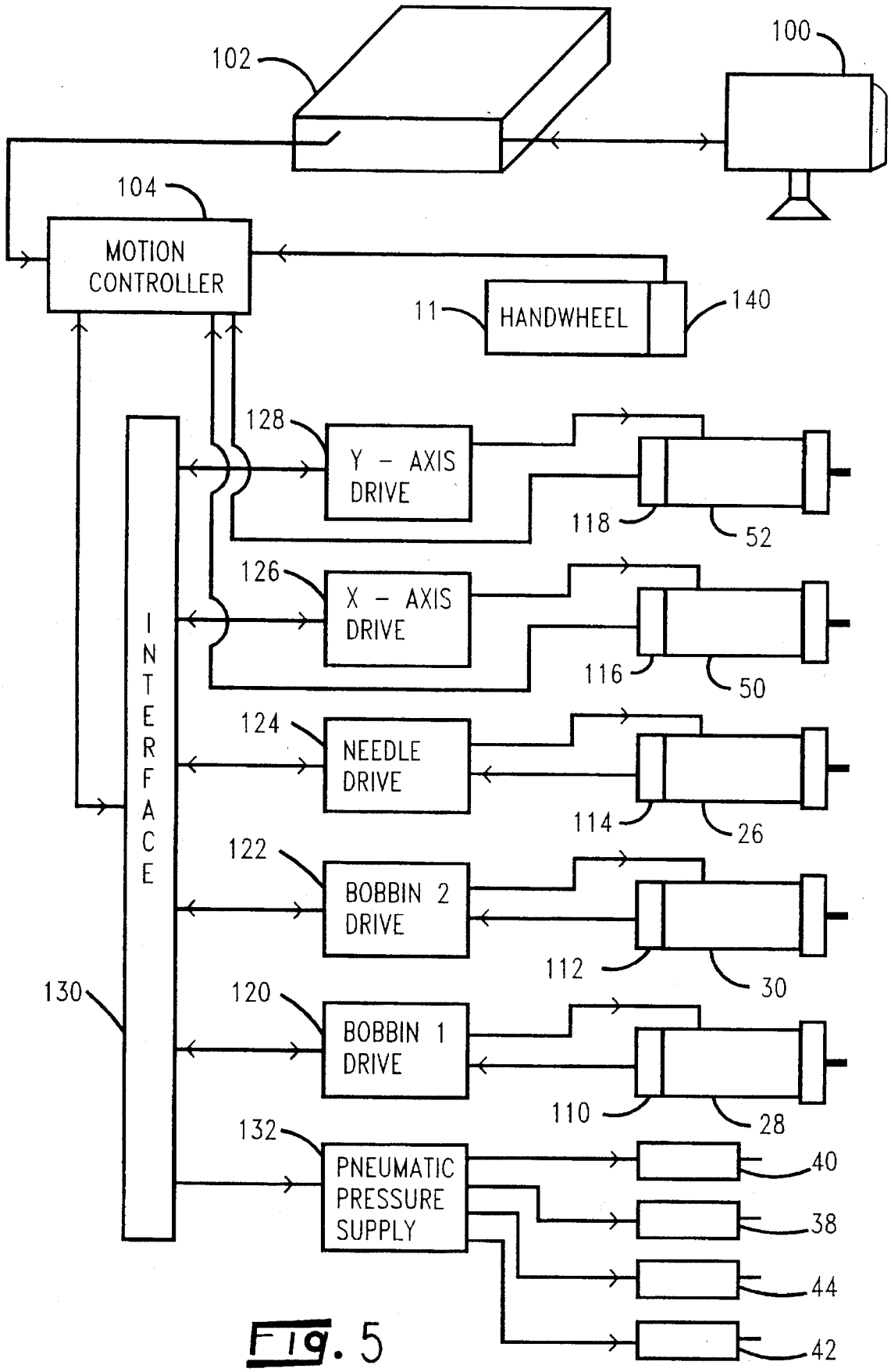
FIG. 5 is a functional block diagram of the feedback and command structure of an electronically geared, two-needle, belt loop tacking sewing machine.

Position monitoring can be by any effective method of position signaling. In the preferred embodiment as shown in FIG. 5, each of the servo motors is equipped with an encoder 110, 112, 114, 116, and 118 for monitoring position of the servo motor load. Encoder position information is incremental. Incremental position information can be generally viewed as a series of pulses, or clicks wherein each pulse represents a specific amount of angular movement about the servo motor axis. For example, an encoder that has a resolution of one pulse per degree of movement about the servo motor axis would output 360 pulses for each complete revolution of the servo motor. Servo motor rotation equates to a specific position of the load so that 150 pulses from home position of the needle encoder 114 equates, for example, to the needles 12 and 14 being positioned one inch above the fabric 90. In an alternative embodiment, absolute position information is provided in the form of angular position from reference about the servo motor axis so that instead of a series of pulses, the encoder outputs a signal corresponding to 100 degrees when the servo motor has moved 100 degrees from reference. Absolute position information can also be easily determined from incremental position information.

With continued reference to FIG. 5, each servo motor 26, 28, 30, 50, and 52 is connected to a servo drive 120, 122, 124, 126, and 128 for providing excitation to the servo motor. Motion commands for each of the servo motors 26, 28, 30, 50, and 52 are generated by a motion controller 104 and then passed to the servo drives 120–128 via an interface 130. The interface 130 is either a digital data bus or it is a direct, hardwired link between the motion controller 104 and the servo drives 120–128 and pneumatic pressure supply 132. Motion commands in the preferred embodiment are in the form of analog voltages, but it will be understood that digital motion commands may also be used. Each motion command utilizes S-curve profiling to eliminate machine jerk, and it instructs the corresponding servo drive to provide a specific amount of current to the servo motor. The motion controller 104 knows how far each servo motor 26, 28, 30, 50, and 52 must travel in a given time period, so it periodically adjusts the analog voltage level of each motion command to prevent overtravel or undertravel of the servo motor. For example, to move bobbin 22 an analog motion command corresponding to the desired motion of the bobbin 22 is generated by the motion controller 104 and sent out to the bobbin 1 drive 120. The analog motion command is received by the bobbin 1 drive 120 and used to provide an electrical current for excitation of the bobbin 1 servo motor 28. Encoder 110 monitors the position of servo motor 28 and outputs this positional information through the bobbin drive 120 to the motion controller 104. Motion controller 104 receives the digital positional information from the bobbin drive 120 and uses it for two purposes. First, the encoder 110 positional information is used by the controller 104 as feedback to determine whether the servo motor 28 has traveled to the point where it should be. If commanded motion differs from actual motion by a predetermined distance, then the motion controller 104 increases or decreases the voltage level of the analog motion command to increase or decrease servo motor 28 speed. Second, the encoder positional information is used by the controller 104 to limit the torque on the servo motor 28. This torque limiter prevents the motion controller 104 from increasing the analog voltage motion command beyond a predetermined limit, thereby limiting the maximum amount of current to be supplied to servo motor. In an alternate embodiment, encoder 110 positional information is used by the bobbin drive 120 as feedback to enable comparison of commanded motion with actual motion. In this alternate embodiment the bobbin 1 drive 120 itself adjusts the current to the servo motor 28 to correct any overtravel or undertravel (smart drive).

In the preferred embodiment, ac servo motors are used for the bobbin servo motors 28 and 30 and the needle servo motor 26, and dc servo motors are used for the X and Y axes. Servo drives 120, 122, and 124 for each of the ac servo motors are preferably YESKAWA servo drives. Servo drives for each of the dc servo motors are preferably COMPUMOTOR OEM670X servo drives. Encoders 110, 112, and 114 for each of the ac servo motors 26–30 are preferably magnetic encoders, such as SONY MAGNESCALE INC. Magnetic Rotary Encoder RE90B-2048C. Encoder 110–114 position signals are also routed through the servo drives 120–124 to the interface 130 for use by the motion controller 104 in calculating motion commands.

X axis servo motor 50 and Y axis servo motor 52 are preferably dc servo motors. Servo drives 126 and 128 for each of these dc servo motors are preferably COMPUMOTOR OEM670X servo drives. Encoders 116 and 118 for each of the dc servo motors 50 and 52 are preferably optical encoders, such as COMPUTER OPTICAL PRODUCTS, INC. CM350-1000-L. Encoder 116 and 118 position signals are routed directly to the motion controller 104. The encoder position information is used by the controller 104 as servo motor feedback control.

With continued reference to FIG. 5, the motion controller 104, which is part of a computer 102, and its associated software can conceptually be viewed as a plurality of motion command axes so that a command axis is established for each servo motor and its corresponding drive. For example, a command axis is established for the needle drive 124, the needle servo motor 26, and the needle servo motor encoder 114. A separate command axis is established for the bobbin 1 drive 120, the bobbin 1 servo motor 28, and the bobbin 1 servo motor encoder 110. Each motion command axis calculates motion commands as a function of encoder position information from all servo motors 28, 30, 32, 50, and 52. Motion commands provide the servo drives 120–128 with information relating to the desired motion of the servo motors 26, 28, 30, 50, and 52, and each motion command and resulting servo motor motion can generally be viewed as a pulse due to its relatively short duration. Faster stitching operations require shorter duration and higher frequency motion commands. The motion controller 104 is programmed to control the position of the servo motors 26, 28, 30, 50, and 52 by generating motion commands corresponding to the frequency and current of these pulses to be supplied to the servo motors. In the preferred embodiment, PC Bus Motion Controller cards, such as GALIL DMC-1000 cards having eight axes of motion control per card with multiple card synchronization, are used within the computer 102. Each axis of the motion controller 104 generates an appropriate motion command for its corresponding servo motor and drive.

Monitoring by the motion controller 104 of encoders 110–118 enables electronic gearing of the bobbins 22 and 24 and needles 12 and 14. Encoder 110–118 monitoring is used, for example, by designating one of the servo motors as the master with the other servo motors slaved to the master. For example, in the preferred embodiment, the bobbin servo motors 28 are slaved to the needle servo motor 26, which is the master, so that each slaved controller axis monitors the needle servo motor encoder 114 and generates the appropriate motion command for concerted movement of the slaved servo motors with the needle servo motor 26. In an alternate embodiment, any of the servo motors may be the master. If positional information provided via the encoders 110–114 indicates that one of the slave servo motors is unable to keep up with the master servo motor and lags the master servo motor by, for example, 50 encoder pulses or greater, the motion controller 104 will cause the master servo motor to slow. This effectively flipflops the identities of the servo motors and the slave servo motor suddenly becomes the master servo motor.

In the preferred embodiment, the X axis servo motor 50 and Y axis servo motor 52 are slaved to the needle servo motor 26 in such a way that the motion of the X-Y table 48 is as slow as possible. In other words, when the needles 12 and 14 move up and clear the fabric 90, the X-Y table 48 will begin to move, and the speed of the X-Y table 48 is calculated to achieve the desired X-Y axis movement in the known time required for the needle to raise to the top of its travel and return to the point of entering the fabric 90 again. Consuming the maximum length of time between stitches in order to move the X-Y table 48 dampens otherwise jerky machine motions and reduces or eliminates the problems associated with acceleration and deceleration, thereby enabling the sewing machine 10 to achieve the smoothest, tightest stitch possible. In the preferred embodiment, the X-Y table begins its motion when the needle encoder 114 has output 2800 pulses from home position with the needles 12 and 14 rising to a height approximately one fourth of an inch above the plane of the pant guide 36, and the X-Y table completes its motion when the needle encoder 114 has output 4000 pulses from home position and the needles 12 and 14 again lower to a height of approximately one fourth of an inch above the plane of the pants guide 36.

As an alternative to the master-slave arrangement of the preferred embodiment, electronic gearing is enabled by generating motion commands without reference to a master. Each controller axis receives encoder positional information from all other encoders and generates motion commands based on the positions of all sewing parts. If encoder positional information indicates that one of the servo motors is unable to keep up with the others and lags the other servo motors by, for example, 50 encoder pulses or greater, then that lagging servo motor is designated as master and all other controller axes are slaved to it to maintain electronic gearing. Therefore, an alternate embodiment is disclosed whereby a master-slave arrangement does not exist until there is a lag by one of the servo motors.

Each encoder 110–118 is equipped with a reference position indicator, enabling the motion controller 104 to command each servo motor 26, 28, 30, 50, and 52 to find the reference point and then move to a "home" position. This home position is used to initialize the sewing machine 10 for start of sewing operations. The encoders 110–118 sense movement from the home position and produce signals corresponding to such movements. Initialization (moving servo motors to the home position) and stitch pattern selection is enabled by use of a user interface 100 such as, for example, a touch screen monitor. A user menu software package, such as Visual Basic, is used to generate user interface screens. Stitch patterns are stored in electronic storage, including computer 102 hard disk and other magnetic media, RAM, and ROM, and selected by the user through the touch screen monitor 100.

Shown in FIG. 1 is a handwheel 11 which is similar in function to a conventional sewing machine handwheel. The handwheel 11 becomes operable after selecting it from the touch screen monitor 100. As FIG. 5 illustrates, an encoder 140 is connected to the handwheel 11 for providing the motion controller 104 with handwheel motion signals., Alternatively, a servo motor may be connected to the handwheel 11 for providing force reflective movement of the handwheel 11. Once the handwheel 11 is selected, all sewing parts become slaved to the handwheel 11 so that the handwheel motion signals dictate all motion commands being sent out by the motion controller 104. Therefore, the handwheel 11 provides a capability for manual mode, electronically geared movement of all electronically geared sewing parts.

The computer 102, in addition to enabling the function of electronic gearing of the sewing parts, also enables a variety of other automated functions. One such function enabled by the computer 102 is torque limiting for improved safety. The computer 102 calculates and monitors the current that is required per pulse for each servo motor. When, for example, the needles 12 and 14 are going through heavy fabric 90, more current per pulse to the needle servo motor 26 (more torque) is required to maintain the desired speed of operation; i.e., the servo motor 26 torque requirement goes up. Likewise, if the needle tries to go through a finger, more current will be required to maintain the selected speed of operation. By manual input through the user interface 100 or by default programmer setting, the computer 102 has an established torque limit. This torque limit is continuously compared to the servo motor torque requirement. When a finger is hit by a needle 12 and 14, or when some other obstruction causes an excessive amount of required torque, the computer 102 turns off the sewing machine 10, thereby preventing further damage to the finger or other obstruction instead of commanding the servo motor 26 to provide torque above the torque limit. It also prevents possible self-destruction of the sewing machine 10 itself.

Torque limit shut down of the sewing machine 10 for blockage of a servo motor is a two step procedure. First, a user defined current limit prevents the computer 102 from commanding a current level in excess of the defined limit. The current limit will vary depending on the thickness and resistive properties of the material being sewn. For thin materials, a low current limit is set. For thicker materials, a higher current limit is set. Once the current limit is reached, the computer will hold the current at that level until encoder positional information indicates that the blocked servo motor is lagging by, for example, 50 encoder pulses or greater. At this point, the master and slave servo motors flipflop identities if the blocked servo motor is a slave. If the blocked servo motor is the master, no flipflop occurs. If the blocked servo motor continues to lag by, for example, an additional 50 encoder pulses or greater, despite the fact that maximum current is being commanded, then the computer turns off the sewing machine 10.

Another function enabled by the computer 102 is real time production and maintenance monitoring of the sewing machine 10. The computer 102 monitors the amount of time that the sewing machine 10 is being operated, the speed at which it operates, and the power required to operate it over a period of time. This feature enables automated maintenance scheduling of the sewing machine 10.

Components are modularized to enhance maintainability. For example, the bobbins 22 and 24 shown in FIG. 3 can be easily removed and replaced with loopers. The versatility of electronically gearing the needles 12 and 14 to the bobbins 22 and 24 enables the user to make such parametric changes without having to manually reset other sewing parameters. Electronic gearing enables automatic adjustment to new sewing parameters.

Countless variations exist for the application of electronic gearing to sewing operations due to the elimination of conventional linkages and drive shafts gearing the needle to the bobbin. One such variation is a felling machine for sewing, for example, the interior seams of blue jeans. This type of machine typically requires a short throat for maintaining high speeds. Electronic gearing enables the high speed operation of even long throated sewing machines since there are no mechanical linkages or drive shafts to slow down operation.

Figure 6A:
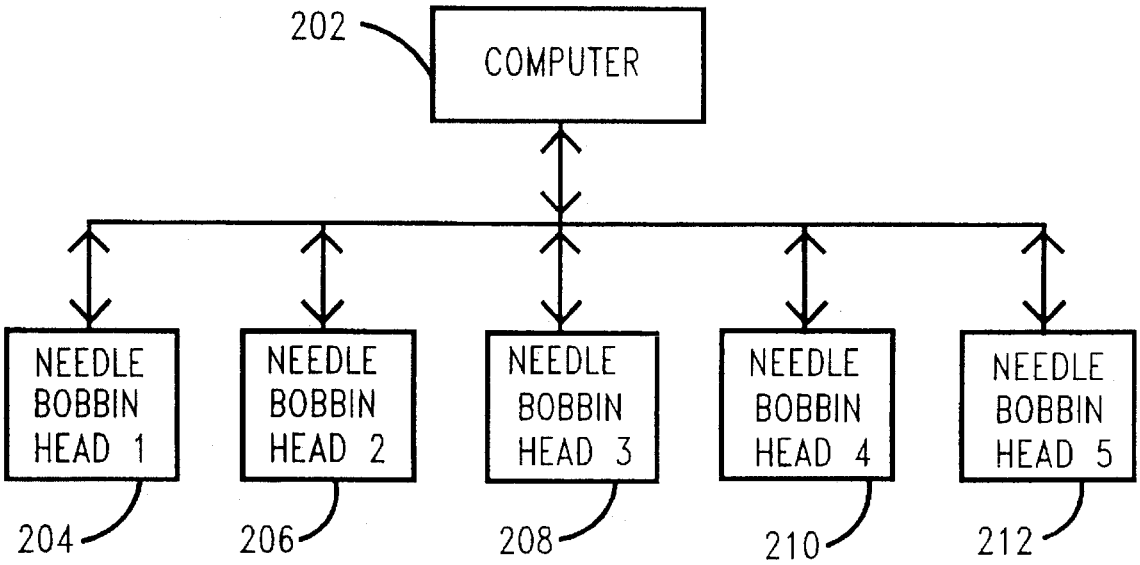
FIG. 6A is a functional block diagram of the feedback and command structure of an electronically geared, five-needle, five-hole, button hole sewing machine.
Figure 6B:
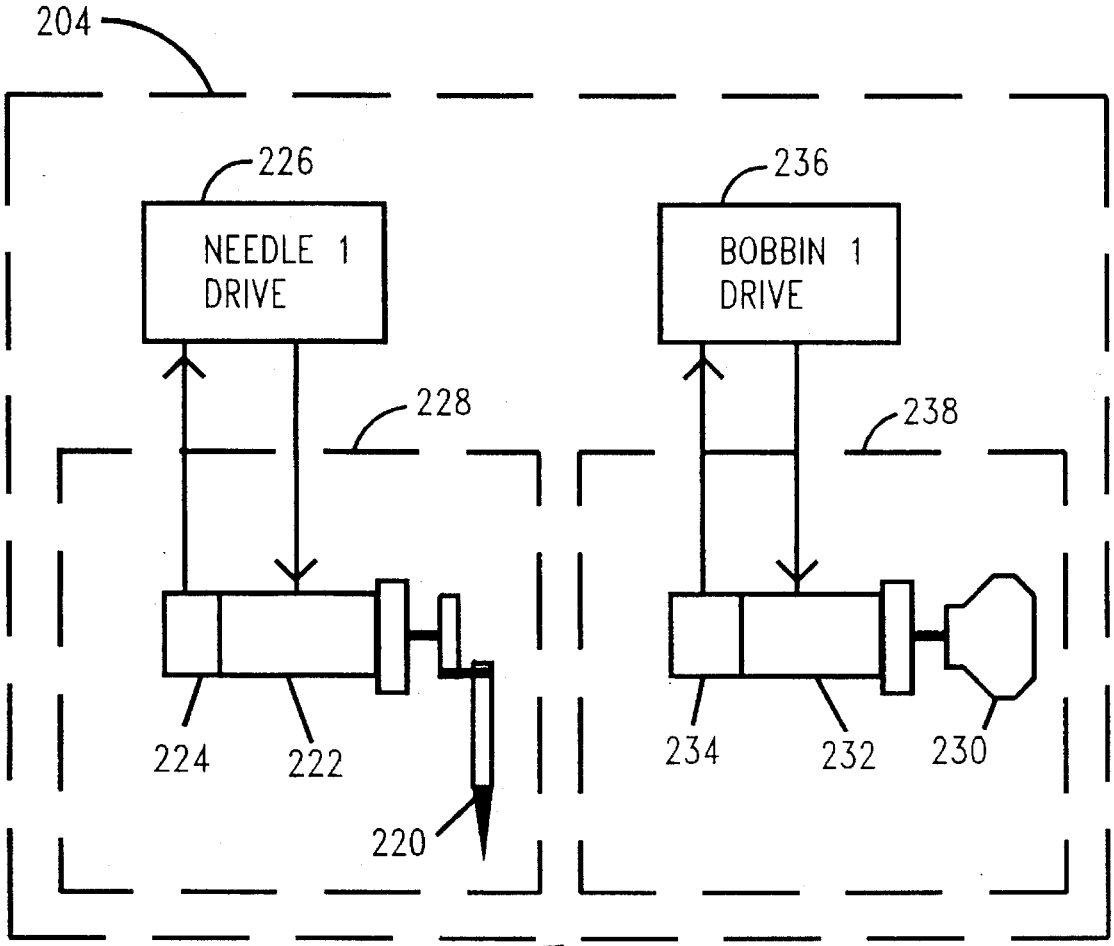
FIG. 6B is a block diagram of a needle/bobbin head for the button hole sewing machine of FIG. 6A.
Figure 6C:
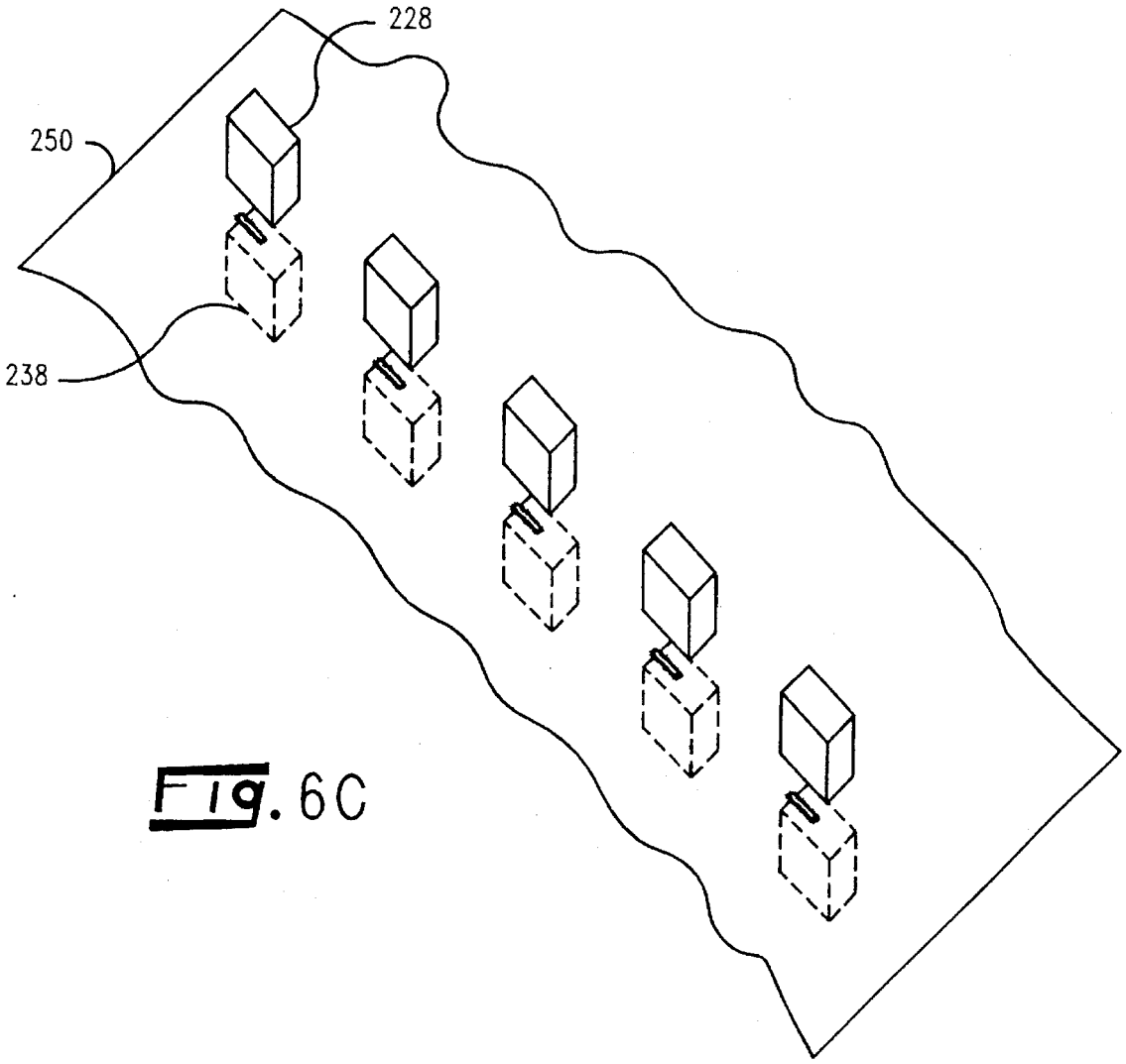
FIG. 6C is a somewhat isometric view of the sewing heads for the button hole sewing machine of FIG. 6A.

Another application of the present invention is a button hole sewing machine for sewing multiple button holes simultaneously. FIG. 6A shows a high-level block diagram for the configuration of a five-hole, button hole sewing machine. A computer 202 coordinates the electronic gearing of five needle/bobbin heads 204, 206, 208, 210, and 212 that are spaced apart, center to center, by distances small enough to allow simultaneous sewing of button holes; e.g., about 2.5 to 4.0 inches. As shown in FIG. 6B, each needle/bobbin head 204–212 comprises at least a needle 220 with a corresponding servo motor 222, encoder 224, and drive 226, and a bobbin 230 with a servo motor 232, encoder 234, and drive 236. The needle servo motor 222, encoder 224, and the needle 220 form a needle assembly 228. The bobbin servo motor 232, encoder 234, and the bobbin 230 form a bobbin assembly 238. As FIG. 6C illustrates, the needle assembly 228 and bobbin assembly 238 of each sewing head 204–212 are structurally secured opposite to each other so that the needle assembly 228 of each head is positioned on the opposite side of the fabric 250 than its corresponding bobbin assembly 238 while sewing. Electronic gearing of each of the needle/bobbin heads 204–212 is enabled by use of positional information provided by, for example, encoders attached to the servo motors as previously described. The needle of each head 204–212 is electronically geared to the bobbin of the same head. While it is not necessary, it is also preferred to electronically gear together the needles and bobbins of all of the heads 204–212.

Multiple head applications of the present invention is made possible because the needle and bobbin are physically freed from each other. This physical separateness enables the sewing heads 204–212 to be moved in three dimensions while sewing, thereby enabling three-dimensional sewing operations. Now, instead of bringing the fabric to the sewing machine, the present invention enables the sewing machine to be brought to the fabric.

It is contemplated, and will be apparent to those skilled in the art from the preceding description and accompanying drawings that modifications and/or changes may be made in the embodiments of the invention. Accordingly, it is expressly intended that the foregoing description and accompanying drawings are illustrative of preferred embodiments only, not limiting thereto, and that the true spirit and scope of the present invention be determined by reference to the appended claims.

We claim:

1. A sewing apparatus for sewing a thread through a material, comprising:

a plurality of sewing parts, each sewing part being movable through a range of positions in a sewing motion for sewing the thread in the material;

a plurality of servo motors connected to said sewing parts for driving said sewing parts in the sewing motion;

monitors for producing monitor signals substantially continuously corresponding to the positions of said sewing parts;

data acquisition and control means connected to said servo motors and receiving said monitor signals for electronically gearing the movements of said sewing parts so that said sewing parts move in concert with each other, said data acquisition and control means including at least one motion controller having multiple control axes for receiving monitor signals from a plurality of said monitors and for responding to said plurality of monitor signals to produce motion commands for each servo motor; and a user interface connected to said data acquisition and control means for inputting commands to control the operation of the apparatus.

2. The sewing apparatus of claim 1 wherein said monitors further comprise a plurality of encoders attached to said servo motors.

3. The sewing apparatus of claim 1 wherein said plurality of sewing parts further comprises at least a needle and a bobbin.

4. The sewing apparatus of claim 1 wherein said data acquisition and control means further comprises:

a plurality of servo drives interconnected with said servo motors and said controller for receiving motion commands from said controller and supplying power to said servo motors in response to said motion commands.

5. The sewing apparatus of claim 1 wherein said controller designates one of said sewing parts as a master part and at least one other sewing part as a slave part and issues motion commands for said slave part that are responsive to monitor signals corresponding to the position of said master part.

6. The sewing apparatus of claim 5 wherein said controller further comprises means for changing the designation of said master part to a slave part and changing one of said slave parts to a master part when said one slave part is lagging said master part by a threshold distance.

7. The sewing apparatus of claim 1 wherein said data acquisition and control means further comprises shut down means for determining the rotational position difference between the needle and bobbin and stopping all of said servo motors if the rotational position difference between the needle and bobbin exceeds threshold limits.

8. The sewing apparatus of claim 1 further comprising:

a handwheel;

a handwheel monitor being responsive to movement produced by the handwheel to produce handwheel monitor signals corresponding to the position of said handwheel; and said controller being responsive to the handwheel monitor signals to issue motion commands to said plurality of servo motors causing the plurality of sewing parts to move to positions corresponding to the positions of said handwheel, whereby said sewing parts are electronically geared to said handwheel.

9. A sewing apparatus comprising:

a needle;

a needle drive unit for moving the needle in a sewing motion;

a bobbin;

a bobbin drive unit for moving the bobbin in a sewing motion;

a first servo motor connected to drive the needle drive unit;

a second servo motor connected to drive the bobbin drive unit;

a needle monitor for producing a needle monitor signal substantially continuously corresponding to the position of said needle;

a bobbin monitor for producing a bobbin monitor signal substantially continuously corresponding to the position of said bobbin;

said needle, needle drive unit, bobbin, bobbin drive unit, first servo motor, second servo motor, needle monitor, and bobbin monitor comprising a first sewing head;

data acquisition and control means including a motion controller having multiple axes of control for receiving and responding to said needle and bobbin monitor signals for electronically gearing said bobbin to said needle so that said needle and bobbin travel in positional unison sufficient to produce a stitch; and input means connected to said data acquisition and control means for inputting commands to control the operation of the sewing apparatus.

10. The sewing apparatus of claim 9 wherein said needle monitor further comprises an encoder attached to said needle servo motor, said encoder producing the needle monitor signal substantially continuously corresponding to the position of said needle.

11. The sewing apparatus of claim 9 wherein said bobbin monitor further comprises an encoder attached to said bobbin servo motor, said encoder producing the bobbin monitor signal substantially continuously corresponding to the position of said bobbin.

12. The sewing apparatus of claim 9 further comprising:

an X-axis mover for moving said fabric along an X-axis during a sewing interval; and a Y-axis mover for moving said fabric along a Y-axis during a sewing interval;

wherein said sewing interval begins when the needle rises to a first level above the fabric and ends when the needle lowers to a second level above the fabric;

said data acquisition and control means for controlling said X-axis mover and said Y-axis mover to begin moving the fabric when the needle rises to said first level above the fabric and to stop moving the fabric when the needle falls to said second level above the fabric.

13. The sewing apparatus of claim 12 wherein said X-axis mover comprises a third servo motor attached to a translation table, and wherein said X-axis servo motor moves said translation table along an X axis during said motion period.

14. The sewing apparatus of claim 12 wherein said Y-axis mover comprises a fourth servo motor attached to a translation table, and wherein said fourth servo motor moves said translation table along a Y-axis.

15. The sewing apparatus of claim 9 wherein said second servo motor rotates twice for each rotation of said first servo motor.

16. The sewing apparatus of claim 9 further comprising:

a computer connected for downloading instructions to said controller;

a first torque servo drive interconnected with said controller and said needle servo motor for receiving needle motion commands from said controller and converting said needle motion commands to power commands for said needle servo motor; and a second torque servo drive interconnected with said controller and said bobbin servo motor for receiving bobbin motion commands from said controller and converting said bobbin motion commands to power commands for said bobbin servo motor;

said controller designating said needle as a master part and said bobbin as a slave part and issuing bobbin motion commands that are responsive to said needle monitor signals.

17. The sewing apparatus of claim 16 wherein said controller further comprises means for changing the designation of said master part to a slave part and changing one of said slave parts to a master part when said slave part is lagging said master part by a threshold distance.

18. The sewing apparatus of claim 9 wherein said input means further comprise means for programming stitch patterns directly into the apparatus and electronically storing said stitch patterns for later retrieval.

19. The sewing apparatus of claim 9 wherein said data acquisition and control means further comprises shut down means for determining the rotational position difference between the needle and bobbin and stopping all of said servo motors if the rotational position difference between the needle and bobbin exceeds threshold limits.

20. The sewing apparatus of claim 9 further comprising:

a handwheel;

a handwheel monitor being responsive to movement produced by the handwheel to produce handwheel monitor signals corresponding to the position of said handwheel; and said controller being responsive to the handwheel monitor signals to issue motion commands to said first and second servo motors causing said needle and bobbin to move to positions corresponding to the positions of said handwheel, whereby said needle and bobbin are electronically geared to said handwheel.

21. The sewing apparatus of claim 9, further comprising a second sewing head operatively connected to and controlled by said data acquisition and control means.

22. The sewing apparatus of claim 21, wherein said sewing heads are electronically geared to each other by said controller so that all sewing heads operate in substantial concert sufficient to sew the same material.

23. A method for electronically gearing a plurality of sewing parts on a sewing machine wherein said plurality of sewing parts comprises at least one needle and one bobbin, said method comprising the steps of:

designating one of said sewing parts as a master part;

designating all nonmaster sewing parts as slave parts;

initializing said sewing parts to a home position;

monitoring the positions of said sewing parts to produce monitor signals substantially continuously corresponding to the positions of said sewing parts;

directing said monitor signals to a controller having multiple control axes;

producing master commands and slave commands in said controller, said master commands being based upon a desired movement of the master part and said slave commands being based upon the monitor signals representing the position of said master part;

commanding movement of said master part in response to said master commands; and commanding movement of said slave parts in response to said slave commands moving said slave parts as a function of the monitored position of said master part so that said master and slave parts operate substantially in unison.

24. The method of claim 23 further comprising, when said slave part is lagging said master part by a threshold distance, changing the designation of said master part to a slave part and changing one of said slave parts to a master part.

25. A sewing apparatus for sewing a thread through a material, comprising:

a sewing needle for sewing the thread through the material;

a needle motor drivingly connected to the needle for driving the needle through a range of needle positions in a reciprocating motion to sew the thread in the material;

a needle drive connected to the needle motor for providing power to the needle motor;

a bobbin for hooking the thread as the needle sews the thread in the material;

a bobbin motor drivingly connected to the bobbin for driving the bobbin through a range of bobbin positions in a reciprocating motion to sew the thread in the material;

a bobbin drive connected to the bobbin motor for providing power to the bobbin motor;

a handwheel;

a needle monitor for producing needle monitor signals substantially continuously corresponding to the position of the needle;

a bobbin monitor for producing bobbin monitor signals substantially continuously corresponding to the position of the bobbin;

a handwheel monitor for producing handwheel monitor signals substantially continuously corresponding to the position of the handwheel; and a controller responsive to the handwheel, needle, and bobbin monitor signals to control the needle and bobbin motors to move the needle and bobbin in their range of reciprocating motion in response to motions of the handwheel.

26. The apparatus of claim 25 wherein said needle monitor produces needle monitor signals substantially continuously corresponding to the position of the needle during travel of the needle toward the bobbin.

27. The sewing apparatus of claim 1 wherein said sewing parts comprise a needle and bobbin and wherein said controller designates the needle as a master part and the bobbin as a slave part and issues motion commands for the slave part that are responsive to monitor signals corresponding to the position of said master part.

28. The apparatus of claim 3 wherein said needle monitor signals substantially continuously correspond to the position of the needle during travel of the needle toward the bobbin.

29. The apparatus of claim 9 wherein said needle and bobbin monitor signals substantially continuously correspond to the positions of the needle and bobbin, respectively, during travel of the needle toward the bobbin.

30. The sewing apparatus of claim 9 wherein said data acquisition and control means further comprises shut down means for determining the rotational position difference between the needle and bobbin and stopping all of said servo motors if the rotational position difference between the needle and bobbin exceeds threshold limits.

31. The apparatus of claim 24 wherein said step of monitoring the positions of said sewing parts further comprises producing monitor signals substantially continuously corresponding to the positions of said sewing parts during travel of the needle toward the bobbin.

32. A sewing apparatus for sewing thread in material, said sewing apparatus including a frame having a needle mount positioned adjacent to but spaced apart from a sewing base, said sewing apparatus comprising:

a stationary needle unit fixedly mounted on the needle mount of the frame in a spaced apart relationship with the sewing base for sewing a thread in material that is presented at the base, said needle unit comprising:

a needle for carrying the thread;

a needle drive unit for moving the needle in a sewing motion;

a stationary bobbin unit fixedly mounted on the frame adjacent to the frame in a spaced apart relationship with said stationary needle unit, said bobbin unit comprising:

a bobbin including a hook for engaging the thread carried by the needle;

a bobbin drive unit for moving the bobbin in a sewing motion;

a first servo motor fixedly mounted on the needle mount of the sewing apparatus frame proximate to the needle drive unit and connected to drive the needle drive unit and move the needle in a reciprocating motion along the longitudinal axis of the needle to pierce and penetrate material positioned adjacent to the sewing base and carry the thread through the material to a position adjacent to the bobbin;

a second servo motor mounted on the sewing apparatus frame proximate to the bobbin drive unit and connected to drive the bobbin drive unit in a sewing motion causing the hook on the bobbin to engage the thread carried by the needle through the material;

a needle monitor substantially continuously monitoring the needle position and for producing a needle monitor signal substantially continuously corresponding to the position of said needle;

a bobbin monitor substantially continuously monitoring the bobbin position and for producing a bobbin monitor signal substantially continuously corresponding to the position of said bobbin;

wherein said needle unit, bobbin unit, first servo motor, second servo motor, needle monitor, and bobbin monitor comprise a first sewing head;

data acquisition and control means including a base computer interfaced with at least one controller, said base computer for controlling the operation of said controller and downloading instructions into the controller corresponding to a stitch pattern and speed of stitching, said controller being responsive to the downloaded instructions to control the first sewing head to sew the downloaded stitch pattern at the downloaded speed, said controller being responsive to the substantially continuous monitor signals to electronically gear the first and second servo motors to move the needle and bobbin in unison sufficient to stitch; and means for moving the material relative to the fixed sewing base, needle and bobbin while the material is being sewn by said first sewing head including means to control the movement of said material so that the movement of the material is substantially stopped while the needle is penetrating the material so that movement of the material does not interfere with the sewing action of the needle and bobbin; and a user interface connected to said data acquisition and control means for inputting user commands.

33. The apparatus of claim 32 wherein said needle and bobbin monitors substantially continuously monitor needle and bobbin positions at least when the needle is piercing and penetrating the material.

34. The apparatus of claim 32 further comprising:

a second sewing head mounted adjacent to said first sewing head; and said at least one controller being operable to control the operation of the second sewing head to cause said sewing heads to sew in substantial unison so that movement of the material is substantially stopped while the needles of the first and second sewing heads are penetrating the material so that the movement of the material does not interfere with the sewing of either sewing head.

35. The apparatus of claim 34 wherein said needles of said first and second sewing heads are separated by a distance of between about two and one half inches and four inches.

36. The apparatus of claim 32 further comprising:

a plurality of additional sewing heads; and said at least one controller being operable to control the operation of the additional sewing heads to cause said sewing heads to sew in substantial unison so that movement of the material is substantially stopped while the needles of all sewing heads are penetrating the material so that the movement of the material does not interfere with the sewing of any sewing head.

37. The apparatus of claim 36 wherein each of said sewing heads is positioned adjacent to at least one other of the sewing heads and the needles of said sewing heads are separated by a distance of between about two and one half inches and four inches.

* * * * *